United States Patent [19]

Turner

[11] Patent Number: 4,762,476

[45] Date of Patent: Aug. 9, 1988

[54] OIL WELL PUMP

[76] Inventor: Richard L. Turner, Rte. 2, Box 138, Broken Arrow, Okla. 74012

[21] Appl. No.: 46,137

[22] Filed: May 4, 1987

Related U.S. Application Data

[63] Continuation of Ser. No. 796,229, Nov. 8, 1985, abandoned.

[51] Int. Cl.[4] ..... F04B 21/04

[52] U.S. Cl. ..... 417/554; 92/185

[58] Field of Search ..... 92/184, 182, 249, 185; 417/554

[56] References Cited

U.S. PATENT DOCUMENTS

| | | | |
|---|---|---|---|
| 116,820 | 7/1871 | Draper | 417/554 |
| 658,912 | 10/1900 | Hare | 417/554 |
| 1,116,467 | 11/1914 | Myers | 417/554 |
| 1,588,705 | 6/1926 | Cope et al. | 417/545 |
| 2,003,679 | 6/1935 | Crickmer et al. | 92/182 |
| 2,674,956 | 4/1954 | Hilton | 92/182 |
| 3,678,809 | 7/1972 | Doutt | 92/249 |
| 3,999,467 | 12/1976 | Engquist | 92/249 |
| 4,395,204 | 7/1983 | Turner | 92/185 |

FOREIGN PATENT DOCUMENTS

| | | | |
|---|---|---|---|
| 2076072 | 11/1981 | United Kingdom | 92/182 |
| 47804 | 4/1978 | U.S.S.R. | 417/554 |
| 48004 | 4/1980 | U.S.S.R. | 417/554 |

*Primary Examiner*—Carlton R. Croyle
*Assistant Examiner*—Theodore Olds

[57] ABSTRACT

An oil well subsurface pump comprising a housing for reciprocal disposition with a working barrel and having one end thereof adapted to be secured to the lowermost end of a sucker rod, or the like, and the opposite end thereof in open communication with the fluid reservoir in a well bore, a ball check valve carried by the housing and disposed within a ball chamber having a stop at one end for limiting the movement of the ball member in one direction and the opposite end open to the well fluid, resilient sealing assemblies interposed between the outer periphery of the housing and the inner periphery of the working barrel and slidable with respect to the barrel during a pumping operation, longitudinally disposed passageways provided in the housing and extending from the ball chamber to a position beyond the upper limit of the sealing assemblies to provide communication through the housing to the annulus between the housing and the working barrel for passage of the well fluid from the fluid reservoir to the annulus for transportation of the fluid to the surface of the well bore, the sealing assemblies being superimposed with respect to one another and each comprising an inner rigid ring having a yieldable annular body disposed therearound with a fluid channel therebetween such that the yieldable annular body is engagable with the inner periphery of the working barrel and is provided with an annular fluid receiving groove on the outer periphery thereof for assuring an adequate lubrication between the sealing assemblies and the working barrel for reducing friction therebetween during a pumping operation, and wherein fluid pressure to the fluid channel expands the yieldable body into sealing engagement with the working barrel.

7 Claims, 2 Drawing Sheets

OIL WELL PUMP

This is a continuation of co-pending application Ser. No. 796,229 filed on Nov. 8, 1985 and now abandoned.

CROSS-REFERENCE TO RELATED PATENTS

This application is an improvement of my prior U.S. Pat. No. 4,229,194, issued Aug. 28, 1978, and entitled "Oil Well Pump", and my prior U.S. Pat. No. 4,395,204, issued July 26, 1983, and entitled "Oil Well Pump".

BACKGROUND OF THE INVENTION

1. Field of the Invention:

This invention relates to improvements in oil well pumps and more particularly, but not by way of limitation, to a reciprocal subsurface oil well pump of a minimum length and stroke for an efficient pumping operation.

2. Description of the Preferred Embodiment:

In producing oil wells it is common practice to provide a pump at the bottom of a well bore, or at least down the well bore in the proximity of the producing subsurface formation. The pump is normally secured to the lowermost end of the sucker rod string, which extends longitudinally through the well bore from a reciprocating device at the surface of the ground. The reciprocating device at the surface is usually a horsehead type apparatus and alternately raises and lowers the string of sucker rods in the well bore. Subsurface pumps have long presented problems in the lifting of the well fluid to the surface of the ground in that the plunger of the pump is usually several feet long and thus requires a relatively long stroke for operation of the pump. This results in substantially great friction and drag on the pump as the pump plunger reciprocates within the working barrel. As a result, the pump may not move freely and the plunger may not have a full stroke, thus reducing the pumping efficiency. In addition, since most of the subsurface pumps are relatively long, it may require several strokes of the pump before a sufficient load is applied to the pump for starting the pumping action. Also, many well fluids contain sand and other foreign particles which hinder the operation of the subsurface pump and frequently damage the working parts thereof.

In order to overcome these disadvantages, the pump shown in may aforementioned prior U.S. Pat. No. 4,229,149 was developed, and comprises a relatively short plunger or housing, as for example, ten or twelve inches in length, and which is threaded at one end for connection with the lowermost sucker rod for reciprocation thereby within the working barrel. The housing is open at one end for receiving the well fluid therein, and a ball check valve is carried by the housing for intermittently admitting the fluid into the fluid passageways of the housing whereby the well fluid may be lifted to the surface of the well. This pump has certain disadvantages, however, in that the sealing members interposed between the outer periphery of the housing and the inner periphery of the working barrel have proven to be a problem in the operation of the pump, and the stop means for limiting the upward movement of the ball member is frequently damaged by the force with which the ball member strikes the stop.

To overcome the disadvantages of the pump shown in my U.S. Pat. No. 4,229,149, I developed the pump shown in my U.S. Pat. No. 4,395,204. Whereas the second pump embodium ent is an improvement, the sealing members between the outer periphery of the pump housing and the working barrel are still somewhat of a problem, and the particular design of the ball stop members showed some disadvantages under actual prolonged use of the pump.

SUMMARY OF THE INVENTION

The present invention contemplates a novel oil well pump which is generally similar to the pump shown in my aforementioned prior patents, and including a particularly improved seal design in combination with an improved structure for the ball stop members. The novel sealing means comprises a yieldable annular ring having the inner periphery thereof tapered radially inwardly in both longitudinal directions from the longitudinal mid point of the ring for receiving pressure fluid for urging the body of the ring radially outward during a sealing operation. In addition, the outer periphery of the ring is provided with a substantially centrally disposed recess or groove. A rigid substantially cylindrical ring is disposed inboard of the inner periphery of the yieldable annular ring and in the relaxed position of the yieldable body, the rigid ring normally engages the "high point" of the inner periphery of the yieldable body. Upon radial expansion of the yieldable body, substantially the entire inner periphery thereof is moved away from the outer periphery of the rigid ring into a sealing engagement with the inner periphery of the working barrel. In addition, the fluid present in the recess provided on the outer periphery of the yieldable body provides lubrication between the sealing means and the working barrel upon reciprocation of the pump plunger therein.

The ball stop means in the pump plunger is of a substantially spherical configuration complementary to the spherical configuration of the outer periphery of the ball member for more efficiently receiving the ball therein during the pumping action. The substantially V-shaped cross-sectional configuration of the ball stop means of my prior U.S. Pat. No. 4,395,204 was found to permit the ball to "bounce around" within the pump, causing damage to both the ball and the stop means. The generally spherical configuration of the stop member receives the ball therein more efficiently, and holds the ball against undue bouncing within the pump plunger during a pumping operation. The novel oil well pump is simple and efficient in operation and economical and durable in construction.

DESCRIPTION OF THE PREFERRED EMBODIMENT

Figure 1:
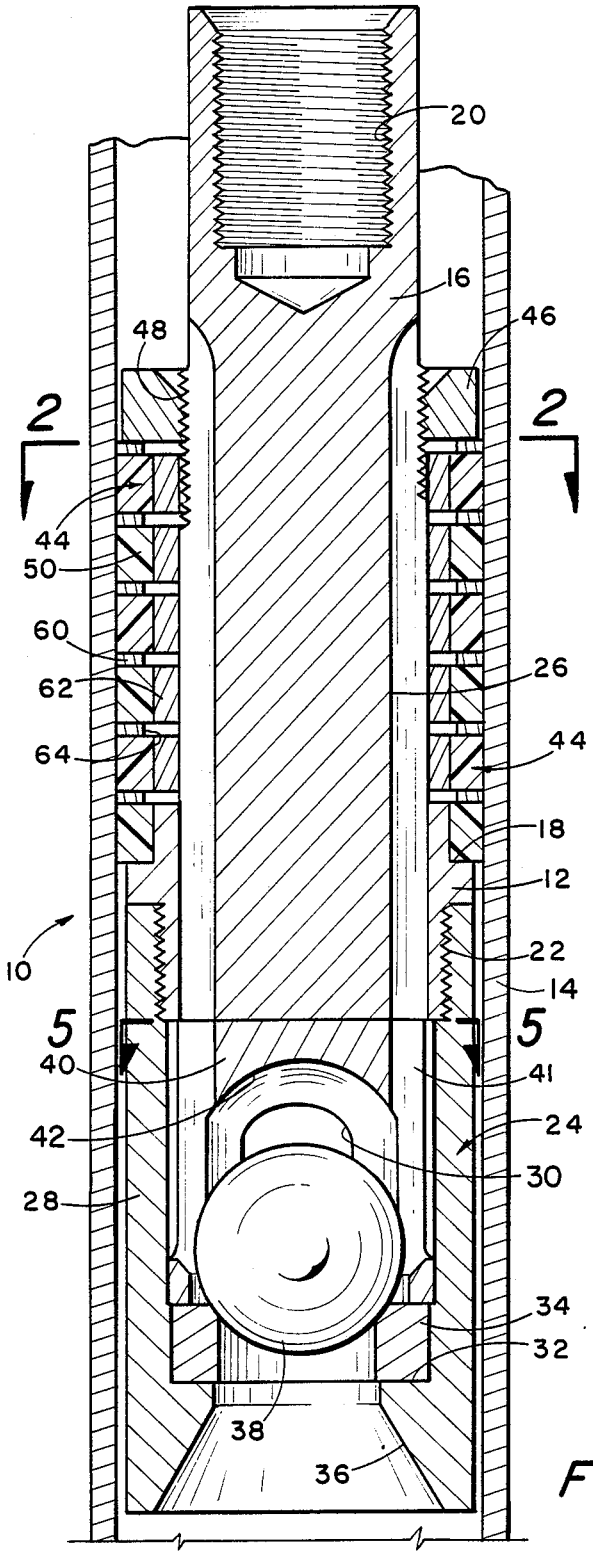
FIG. 1 is a sectional elevational view of one specific embodiment of an oil well pump according to the present invention.
Figure 4:
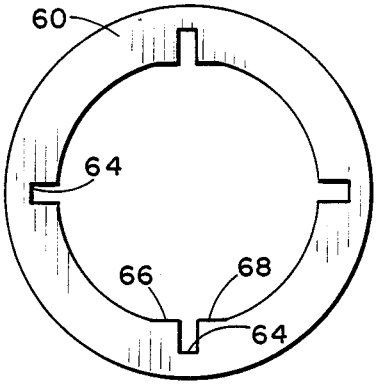
FIG. 4 is a plan view of a ring member used in the oil well pump of FIG. 1.
Figure 5:
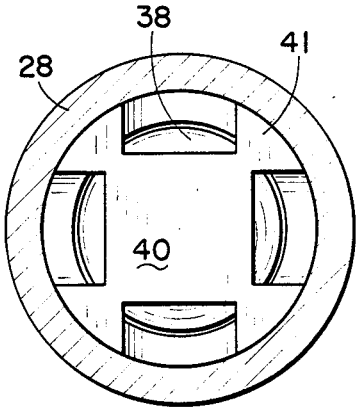
FIG. 5 is a view taken along the line 5—5 of FIG. 1.
Figure 2:
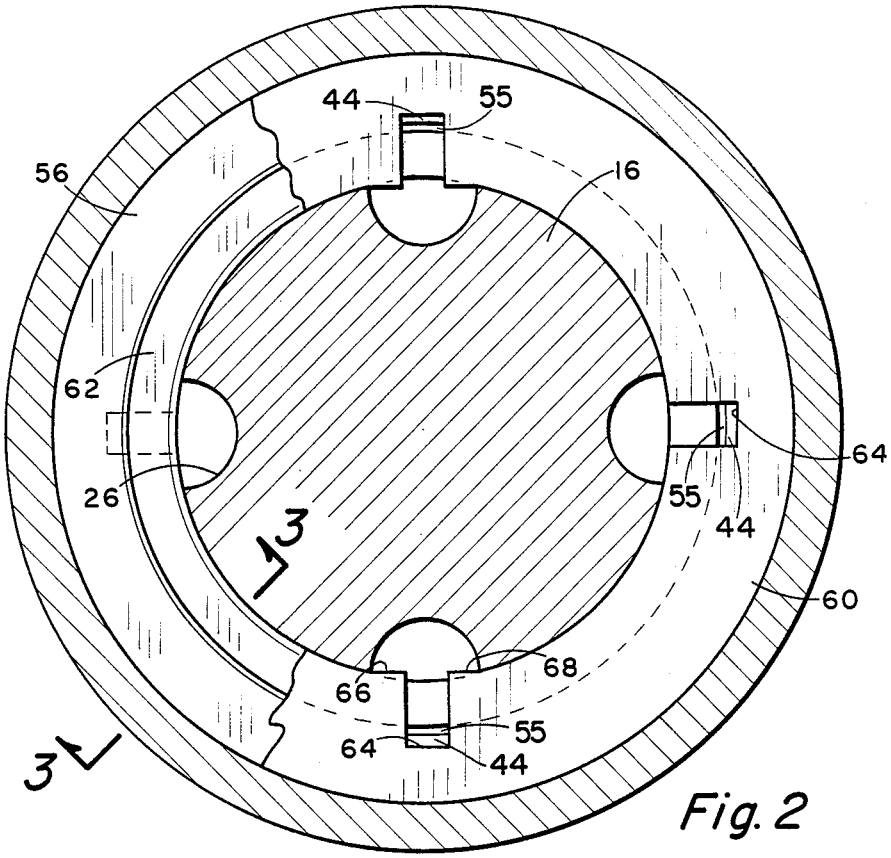
FIG. 2 is a view taken along the line 202 of FIG. 1.

Referring to the drawings in detail, reference character 10 generally indicates a subsurface oil well comprising a pump housing 12 adapted to be reciprocally disposed within a working barrel 14, or the like, normally present in a producing oil well bore (not shown). The working barrel 14 is preferably set within the well tubing (not shown) by a suitable packer (not shown), or the like, as is well known and in such a manner that the pump 10 is disposed in the proximity of or within the producing subsurface formation (not shown) of the well bore (not shown).

The pump housing 12 is provided with a reduced diameter stem 16 extending axially upwardly therefrom providing an annular shoulder 18 around the outer periphery thereof and having a longitudinally extending internally threaded bore 20 provided at the upper end thereof for threaded connection with the lowermost sucker rod (not shown) of the usual sucker rod string extending through the working barrel 14, as is well known. The opposite lower end of the housing 12 is externally threaded at 22 for receiving one end of a cage means 24 thereon. The outer periphery of the reduced neck portion 16 is provided with a plurality of longitudinally extending circumferentially spaced grooves 26 on the outer periphery thereof providing fluid passageways for the pump 10 as will be hereinafter set forth.

The cage means 24 comprises an outer sleeve 28 and an internal ball guide means 40 wherein sleeve 28 is threadedly secured to the threaded portion 22 of the housing 12 and is in open communication with the passageways 26. A plurality of ports 30 are provided in the ball guide means 40 for transmitting fluid from the well bore (not shown) to the passageways 26 as will be hereinafter set forth. An annular shoulder 32 is provided on the inner periphery of the sleeve 28 for supporting a suitable valve seat means 34 which is in communication with the interior of the well bore through the open lower end of the sleeve 28. The ball closure means 38 is loosely disposed within the sleeve 28 for cooperation with the valve seat means 34 to provide alternate open and closed positions for the valve. The ball guide means 40, as provided within the sleeve 28, includes longitudinally extending guides or ribs 41 in engagement with the inner periphery of the sleeve 28. The outer end of the guide means 40 is in abutting engagement with the pump housing 12, and is preferably constructed from a hardened metallic material. A centrally disposed ball stop 42 is provided at the upper end of the guide means 40 and is preferably of a substantially concave spherical configuration complementary to the configuration of the outer periphery of the ball 38. The ribs or guides 41 guide the longitudinal movement of the ball within the cage means 24 during the opening and closing of the valve, and the spherical configuration of the stop 42 cooperates with the complementary configuration of the outer periphery of the ball 38 for reducing any "bouncing around" of the ball in the open position thereof, thus greatly reducing wear and/or damage to the cage means 24.

A plurality of sealing ring assemblies generally indicated at 44 are disposed around the outer periphery of the stem 16 and are superimposed above the shoulder 18. A follower means 46 is threadedly secured at 48 to the stem 16 outboard of the sealing rings assemblies 44 for securing the rings in position around the stem 16, as is well known. The uppermost ends of the passageways 26 terminate at a point outboard of the sealing ring assemblies 44 whereby the well fluid may be transmitted from the well bore (not shown) through the valve seat 34 and into the passageways 26 for delivery to the upper portions of the well tubing (not shown) during a pumping operation, as will be hereinafter set forth.

Figure 3:
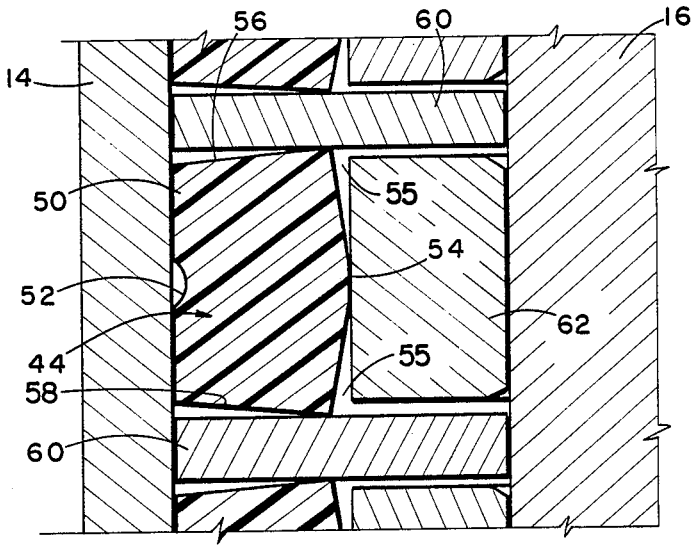
FIG. 3 is a view taken along the line 3—3 of FIG. 2.

As shown in FIG. 3, each sealing ring assembly comprises an annular yieldable body 50 having the outer periphery thereof in engagement with the inner periphery of the working barrel 14. A substantially centrally disposed annular groove or recess 52 is provided around the outer periphery of the body 50. The inner periphery of the body 50 is radially inwardly tapered in both longitudinal directions from the substantial longitudinal center 54 thereof. This in turn creates fluid channels 55 between sealing ring assemblies 44 and the substantially cylindrical rigid rings 62 disposed around the inner periphery of the body 50. In addition, the opposed annular faces 56 and 58 of the body 50 are tapered inwardly in the radially outward direction whereby in the normal relaxed position of the body 50 shown in FIG. 3 the opposed faces of the body 50 will be mostly out of engagement with the annular metallic or rigid rings 60 interposed between each adjacent pair of sealing ring assemblies 44. The inner periphery of the ring 62 engages the outer periphery of the stem 16. In the normal relaxed position of the body 50, the outer periphery of the ring 62 engages only the "high point" 54 of the inner periphery of the body 50. When fluid pressure is applied to the groove or recess 55 as will be hereinafter set forth, the body 50 is expanded circumferentially into a tight sealing engagement with the inner periphery of the working barrel 14 and is expanded longitudinally into a tight sealing engagement with the opposite sides of the rings 60.

The rings 60 are provided with at least one and preferably a plurality of circumferentially spaced radially inwardly directed grooves 64 around the inner periphery thereof. At least one, and preferably two diametrically opposed grooves 64 terminate at the inner periphery of the ring 60 in substantially straight or flat portions 66 and 68 which assure a positioning of the rings around the outer periphery of the stem 16 in such a manner that the grooves 64 are in register with an associated passageway 26. The grooves 64 extend radially outward terminating just beyond the outer periphery of the ring 62 such as to establish fluid communication between the passageways 26 and the recesses 55 via grooves 64.

In use, the stem 16 is threadedly secured to the lowermost sucker rod section in the sucker rod string (not shown) whereby the pump assembly 10 may be reciprocated within the working barrel 14 upon reciprocation of the sucker rod string, as is well known. On the downstroke, the lower end of the cage 24 moves downwardly through the well fluid and the fluid pressure acting on the ball 38 moves the ball upwardly and away from the valve seat 34. The well fluid may then flow through the open valve for delivery to the passageways 26 and may be discharged from the upper ends of the passageways for elevation to the surface of the ground through the usual well tubing (not shown). The upward movement of the ball 38 is limited by the engagement thereof with the end 42 of the ball guide means 40. The configuration of the end 42 generally conforms with the configuration of the outer periphery of the ball 38, and the ball efficiently "nests" within the spherical end 42 in such a manner that relatively little, if any, free "bouncing" of the ball occurs when the valve is in the open position.

On the upstroke, the ball 38 will be returned to the engagement with the valve seat 34, as is well known, and, of course, continued reciprocation of the pump assembly 10 results in the elevating or lifting of the well fluid to the surface of the ground for recovery thereof.

As the well fluid travels upwardly through the passageways 26, a portion of the fluid will enter the grooves 64 of the rings 60 and will be directed into the channels 55 surrounding the inner circumference of the yieldable bodies 50 for urging the outer periphery of the bodies into a tight sealing engagement with the inner periphery of the working barrel 14. In addition, the fluid pressure will tend to seal the yieldable bodies 50 against the sides of the rings 60.

From the foregoing, it will be apparent that the present invention provides a novel subsurface oil well pump of a relatively short overall length, and having efficient sealing rings disposed thereon which not only provides an efficient sealing action but also assures an adequate lubrication between the sealing rings and the working barrel during a pumping operation. In addition, the action of the ball closure member is contained in such a manner as to reduce damage to the pump when the valve is in the open position. The overall useful life of the pump is greatly increased by the improved design of the sealing rings and ball stop means.

Whereas, the present invention has been described in particular relation to the drawings attached hereto, it should be understood that other and further modifications, apart from those shown or suggested herein may be made with the spirit and scope of this invention.

What is claimed is:

1. In a subsurface well pump for disposition within a working barrel of a well bore and arranged for reciprocal movement therebetween for elevating well fluid from a subsurface well fluid reservoir to the surface of the ground for recovery of the fluid, the improvement comprising sealing means provided on the pump for engagement with the inner periphery of the working barrel for precluding leakage of fluid between the working barrel and the ouer periphery of the pump, the sealing means comprising rigid, substantially cylindrical, inner ring means and yieldable annular body means disposed around and covering the entire outer periphery of the inner ring means and adapted to extend, during use, axially into sealing engagement beyond the dimensions of said inner ring means and said yieldable annular body means having an annular groove provided around the outer periphery thereof for receiving a portion of the well fluid therein to assure an efficient lubrication between the outer periphery of the body means and the inner periphery of the working barrel during a pumping operation and said yieldable annular body means having a fluid channel provided around the inner periphery thereof for receiving fluid pressure of the well fluid therein to assure radial expansion and sealing engagement to the inner periphery of the working barrel.

2. In a subsurface well pump, the improvement as set forth in claim 1 wherein the inner periphery of the yieldable body is outwardly tapered in both longitudinal directions from the substantial longitudinal center thereof.

3. In a subsurface well pump, the improvement as set forth in claim 1 wherein the opposed faces of the yieldable body are tapered radially outwardly and in directions towards each other.

4. In a subsurface well pump, the improvement as set forth in claim 1 wherein the inner periphery of the yieldable body is outwardly tapered in both the longitudinal directions from the substantial longitudinal center thereof, and the opposed faces of the body are tapered radially outwardly and in directions toward each other.

5. In a subsurface well pump, the improvement as set forth in claim 1 and including check valve cage means provided on the pump and having ball closure means loosely disposed therein, and ball guide means provided in the interior of the valve cage means for guiding the longitudinal movement of the ball closure means within the valve cage means during opening and closing of the valve.

6. In a subsurface well pump, the improvement as set forth in claim 5 and including ball stop means provided on the ball guide means for limiting the movement of the ball closure means in one direction.

7. In subsurface well pump, the improvement as set forth in claim 6 wherein the ball stop means is of a concave substantially spherical configuration for receiving the ball closure means therein in the open position of the valve.

* * * * *